US009708696B2

(12) United States Patent
Takeda et al.

(10) Patent No.: US 9,708,696 B2
(45) Date of Patent: Jul. 18, 2017

(54) STEEL WIRE MATERIAL AND METHOD FOR MANUFACTURING SAME

(71) Applicant: Kabushiki Kaisha Kobe Seiko Sho (Kobe Steel. Ltd.), Kobe-shi (JP)

(72) Inventors: Mikako Takeda, Kobe (JP); Shohei Nakakubo, Kobe (JP); Kazuhiko Kirihara, Kakogawa (JP); Masayuki Endo, Kakogawa (JP)

(73) Assignee: KOBE STEEL, LTD., Kobe-shi (JP)

( * ) Notice: Subject to any disclaimer, the term of this patent is extended or adjusted under 35 U.S.C. 154(b) by 133 days.

(21) Appl. No.: 14/575,172

(22) Filed: Dec. 18, 2014

(65) Prior Publication Data

US 2015/0101716 A1 Apr. 16, 2015

Related U.S. Application Data

(62) Division of application No. 13/995,565, filed as application No. PCT/JP2011/078560 on Dec. 9, 2011, now abandoned.

(30) Foreign Application Priority Data

Dec. 27, 2010 (JP) ..... 2010-290884

(51) Int. Cl.

| | |
|---|---|
| ***C21D 8/06*** | (2006.01) |
| ***C21D 9/52*** | (2006.01) |
| ***C22C 38/04*** | (2006.01) |
| ***C21D 1/74*** | (2006.01) |
| ***C22C 38/00*** | (2006.01) |
| ***C22C 38/02*** | (2006.01) |
| ***B21B 1/16*** | (2006.01) |
| ***C22C 38/06*** | (2006.01) |
| ***C22C 38/08*** | (2006.01) |
| ***C22C 38/12*** | (2006.01) |
| ***C22C 38/14*** | (2006.01) |
| ***C22C 38/16*** | (2006.01) |
| ***C22C 38/20*** | (2006.01) |
| ***C22C 38/42*** | (2006.01) |
| ***C22C 38/50*** | (2006.01) |
| ***C22C 38/54*** | (2006.01) |

(52) U.S. Cl.

CPC ..... *C22C 38/04* (2013.01); *B21B 1/16* (2013.01); *C21D 1/74* (2013.01); *C21D 8/065* (2013.01); *C21D 9/525* (2013.01); *C22C 38/00* (2013.01); *C22C 38/001* (2013.01); *C22C 38/002* (2013.01); *C22C 38/02* (2013.01); *C22C 38/06* (2013.01); *C22C 38/08* (2013.01); *C22C 38/12* (2013.01); *C22C 38/14* (2013.01); *C22C 38/16* (2013.01); *C22C 38/20* (2013.01); *C22C 38/42* (2013.01); *C22C 38/50* (2013.01); *C22C 38/54* (2013.01)

(58) Field of Classification Search

CPC ... C21D 1/56; C21D 1/58; C21D 1/60; C21D 1/607; C21D 1/613; C21D 1/74; C21D 1/76; C21D 1/763; C21D 1/767; C21D 1/773; C21D 8/06; C21D 8/065; B21B 1/16; B21B 1/163; B21B 1/166; B21B 1/18; B21B 1/20; B21B 13/103; B21B 27/024; B21B 27/035

See application file for complete search history.

(56) References Cited

U.S. PATENT DOCUMENTS

| | | | | |
|---|---|---|---|---|
| 6,890,665 | B1 | 5/2005 | Tanida | |
| 7,037,387 | B2 * | 5/2006 | Nagao | C21D 1/19 148/320 |
| 2006/0048864 | A1 | 3/2006 | Nagao et al. | |
| 2009/0269578 | A1 | 10/2009 | Takeda et al. | |
| 2010/0239884 | A1 * | 9/2010 | Manabe | B21C 1/003 428/659 |

FOREIGN PATENT DOCUMENTS

| | | |
|---|---|---|
| JP | 4 293721 | 10/1992 |
| JP | 8 295992 | 11/1996 |
| JP | 10-158785 A | 6/1998 |
| JP | 10-324923 | 12/1998 |
| JP | 11 172332 | 6/1999 |

(Continued)

OTHER PUBLICATIONS

Charles E. Bates, George E. Totten, Robert L. Brennan, "Quenching of Steel," "Quenching Media," Heat Treating, vol. 4, ASM Handbook (online version), ASM International, 2002, 49 pages total (online printout).*

B.W. Busch, et al., "Medium-energy ion scattering study of arsenic and sulfur segregation to the Fe-9% W(100) surface", Surface Science, vol. 463, Elsevier Science B.V., (2000), pp. 145-155.

International Search Report Issued Feb. 28, 2012 in PCT/JP11/078560 Filed Dec. 9, 2011.

Extended European Search Report issued Apr. 28, 2015 in Patent Application No. 11854159.8.

*Primary Examiner* — Scott Kastler
*Assistant Examiner* — Vanessa Luk
(74) *Attorney, Agent, or Firm* — Oblon, McClelland, Maier & Neustadt, L.L.P.

(57) ABSTRACT

A method of manufacturing a steel wire material that contains 0.05%-1.2% C ("%" means "% by mass," same hereinafter for chemical components.), 0.01%-0.7% Si, 0.1%-1.5% Mn, 0.02% max. P (not including 0%), 0.02% max. S (not including 0%), and 0.005% max. N (not including 0%), with the remainder being iron and unavoidable impurities. The steel wire material has a scale 6.0-20 μm thick and holes of an equivalent circle diameter of 1 μm max. in said scale that occupy 10% by area max. Said scale does not detach in the cooling process after hot rolling or during storage or transportation but can readily detach during mechanical descaling.

10 Claims, No Drawings

(56) References Cited

FOREIGN PATENT DOCUMENTS

| | | | |
|---|---|---|---|
| JP | 2000-246322 | A | 9/2000 |
| JP | 2004 137597 | | 5/2004 |
| JP | 3544804 | | 7/2004 |
| JP | 2005-281793 | A | 10/2005 |
| JP | 2006-28619 | A | 2/2006 |
| JP | 2010 132943 | | 6/2010 |
| JP | 2010-132943 | A | 6/2010 |
| JP | 2010 202954 | | 9/2010 |

* cited by examiner

STEEL WIRE MATERIAL AND METHOD FOR MANUFACTURING SAME

This application is a divisional application of U.S. application Ser. No. 13/995,565 filed Jun. 19, 2013, pending and incorporated herein by reference, which is a National Stage of PCT/JP11/078560 filed Dec. 9, 2011 and claims the benefit of JP 2010-290884 filed Dec. 27, 2010

TECHNICAL FIELD

The present invention relates to a steel wire material and a method for manufacturing the same, and relates more specifically to a steel wire material ("steel wire material" is hereinafter simply referred to as "wire material") for mechanical descaling formed with a scale easily removable by mechanical descaling and a method for manufacturing the same.

BACKGROUND ART

A scale is formed normally on the surface of a wire material manufactured by hot rolling, and it is required to remove the scale before subjecting the wire material to secondary work such as drawing and the like. As such a scale removing method before secondary work, a batch type acid cleaning method was employed in prior arts, however, in recent years, from the viewpoints of the environmental pollution and cost reduction, a mechanical descaling (hereinafter referred to as MD) method has come to be employed. Therefore, the wire material is required to be formed with a scale with excellent MD performance.

As methods for manufacturing a wire material formed with a scale with excellent MD performance, Patent Literatures 1-4 can be cited for example. In Patent Literatures 1, 2, the scale amount remaining in the wire material after MD is reduced by forming a scale high in FeO ratio (or low in $Fe_3O_4$ ratio) and thick. In Patent Literature 3, by lowering the boundary face roughness, propagation of the crack occurring on the boundary face of the scale is promoted, and the remaining scale amount is reduced. In Patent Literature 4, by making the holes of 1 μm or more and 3 μm or less present by a constant amount in the scale, the scale adhesiveness is increased, and the peeling performance is improved.

However, Patent Literatures 1-4 described above have problems as described below. According to the method of forming the scale thick as Patent Literatures 1, 2, even when a bending strain is applied to the wire material by the MD method and the wire material surface is subjected to brushing, it is difficult to perfectly remove the scale. More specifically, according to the MD method, different from the batch type acid cleaning method, it is difficult to remove the entire scale evenly and stably, and even when the wire material formed with thick scale is subjected to MD, the surface of the wire material may occasionally be spotted with finely crushed scale powder. When the remaining scale remaining locally thus increases, in the secondary work such as drawing and the like, problems such as occurrence of a flaw due to the defective lubrication, lowering of the lifetime of the dice and the like are caused.

Also, it is difficult to stably lower the boundary face roughness by the method of lowering the boundary face roughness such as Patent Literature 3, it is difficult to stably form the holes even by the method of forming large holes of 1 μm or more inside the scale such as Patent Literature 4, and it is difficult to stably reduce the remaining scale amount according to either of these technologies.

CITATION LIST

Patent Literature

[Patent Literature 1] Japanese Unexamined Patent Application Publication No. H4-293721
[Patent Literature 2] Japanese Unexamined Patent Application Publication No. H11-172332
[Patent Literature 3] Japanese Unexamined Patent Application Publication No. H8-295992
[Patent Literature 4] Japanese Patent No. 3544804

SUMMARY OF INVENTION

Technical Problems

The present invention has been developed in view of the circumstances described above, and its object is to provide a wire material having a scale capable of easily peeling off by MD and a method for manufacturing the same.

Solution to Problems

The steel wire material of the present invention which solved the problems described above is a steel wire material containing C: 0.05-1.2% ("%" means "% by mass", the same hereinafter for chemical components), Si: 0.01-0.7%, Mn: 0.1-1.5%, P: 0.02% or less (not including 0%), S: 0.02% or less (not including 0%), and N: 0.005% or less (not including 0%), with the remainder being iron and unavoidable impurities, in which a scale with 6.0 μm or more and 20 μm or less thickness is included, and holes of an equivalent circle diameter of 1 μm or less in the scale occupy 10% or less by area.

According to the necessity, the steel wire material of the present invention may also contain (a) Cr: 0.3% or less (not including 0%) and/or Ni: 0.3% or less (not including 0%), (b) Cu: 0.3% or less (not including 0%), (c) at least one element selected from a group consisting of Nb, V, Ti, Hf and Zr by 0.1% or less (not including 0%) in total, (d) Al: 0.1% or less (not including 0%), (e) B: 0.005% or less (not including 0%), and (f) Ca: 0.01% or less (not including 0%) and/or Mg: 0.01% or less (not including 0%).

Further, the present invention also includes a method for manufacturing a steel wire material including the steps of hot rolling steel of any one of the chemical compositions described above at 1,000-1,100° C. of rolling finish temperature, cooling at a rate achieving 0.20-20 sec. of the holding time of 950° C. or above and less than 0.15 sec. of the holding time of 950° C. or below by bringing a non-oxygen medium into contact with the hot rolled steel, and thereafter winding at 750-950° C. In the method for manufacturing, it is preferable that the non-oxygen medium is inert gas or water, and it is further preferable that the inert gas is nitrogen.

Advantageous Effects of Invention

In the steel wire material of the present invention, the thickness of the scale is adjusted to a predetermined range, and the fine holes inside the scale are suppressed. Thus, since the scale easily peels off at the time of MD, sufficient peeling performance can be secured with a simple descaling device, adverse effects (a flaw on the surface of the wire material, defective lubrication and the like due to leaving the scale unremoved) are not exerted in secondary work such as drawing and the like, and the steel wire material of high quality can be provided. Also, because the scale loss is less, high yield can be maintained.

DESCRIPTION OF EMBODIMENTS

With respect to the wire material, the scale is removed by MD before executing secondary work such as drawing and the like, and the lifetime of the dice is shortened when the scale remains after MD. Therefore, the wire material having a scale easily peeling off at the time of MD has been desired.

The MD method is a method for making the scale peel off by applying strain to the wire material to generate cracks inside the scale or in the boundary face of the base iron and the scale. Conventionally, increase of the FeO ratio inside the scale has been executed in order to improve the peeling performance of the scale. This is because the increase of the FeO ratio inside the scale is considered to be effective in improving the peeling performance of the scale at the time of MD because the strength of FeO is weaker than $Fe_2O_3$ and $Fe_3O_4$. In order to increase the FeO ratio inside the scale, it is usually necessary to form the scale (secondary scale formed in or after descaling before finish rolling) at a high temperature, however, when the scale is formed at a high temperature, fine holes (1 μm or less in terms of the equivalent circle diameter) are liable to be generated, these fine holes are liable to cohere to each other, and a row of holes is liable to be formed inside the scale. When such a row of holes is formed, only a part of the scale layer peels off at the time of MD, and the scale remains on the surface of the wire material.

So, as a result of studies by the present inventors, it was found out that formation of the fine holes could be suppressed while securing the thickness of the scale when oxygen from the atmosphere was blocked immediately after hot rolling (finish rolling), more specifically the wire material was made into contact with the non-oxygen medium and was cooled until the start of winding, and the residence time on the high temperature side was extended and the residence time on the low temperature side was shortened in cooling by the non-oxygen medium.

The thickness of the scale is to be 6 μm or more in order to secure the MD performance. The scale thickness is preferably 7 μm or more, more preferably 8 μm or more (particularly 9 μm or more). On the other hand, when the scale thickness exceeds 20 μm, the scale loss increases and the yield drops. Also, in the cooling step and transportation and conveying, the scale peels off and the rust is generated. The scale thickness is preferably 19 μm or less, more preferably 18 μm or less.

Further, the fine holes inside the scale which are the holes of 1 μm or less size in terms of the circle equivalent diameter are to be 10% or less by area. When the fine holes exceeds 10% by area, the fine holes cohere to each other inside the scale, peeling occurs only in the portion at the time of MD, and the scale remains on the surface of the wire material. The area ratio of the fine holes is preferably 9% or less, more preferably 8% or less (particularly 7% or less). Normally, the lower limit of the size of the fine holes of the object of the present invention is approximately 0.1 μm.

By making the thickness of the scale and the area ratio of the fine holes as described above, the remaining scale amount after MD can be made 30% or less by the area ratio relative to the scale amount before MD. This is equivalent to approximately 0.05 mass % or less in terms of the remaining scale amount relative to the mass of the steel wire material. The remaining scale amount is preferably 25% or less by area, more preferably 20% or less by area.

In order to obtain the scale with the properties described above (the scale thickness and the area ratio of the fine holes), it is important to adjust the rolling-completing temperature (finish rolling temperature) and the cooling condition (the ambient atmosphere and the cooling time) after the finish rolling.

The rolling-completing temperature is to be 1,000-1,100° C. When the rolling-completing temperature exceeds 1,100° C., the scale loss increases. On the other hand, when the rolling-completing temperature is below 1,000° C., the scale thickness cannot be secured. The rolling-completing temperature is preferably 1,020-1,080° C.

After the finish rolling, the wire material is made into contact with the non-oxygen medium immediately, oxygen is blocked, and generation of the fine holes inside the scale which grow after the finish rolling is suppressed. It is preferable that the non-oxygen medium is an inert gas or water. Also, it is preferable that the inert gas is nitrogen gas.

In cooling when the wire material is made into contact with the non-oxygen medium, the holding time at a high temperature range (high temperature residence time) is secured for a predetermined time or more, and the holding time at a low temperature range (low temperature residence time) is shortened. More specifically, the wire material is cooled at a rate the holding time at 950° C. or above becomes 0.20-20 sec. and the holding time at 950° C. or below until start of winding becomes less than 0.15 sec. By extending the high temperature residence time at 950° C. or above, growth of the scale can be promoted. Also, when the low temperature residence time at 950° C. or below until the start of the winding becomes 0.15 sec. or more, concentrating at the boundary face of the alloy elements such as Si, Mn, Cr and the like becomes conspicuous, propagation of Fe is impeded, and the scale hardly grows. The high temperature residence time is preferably 0.3-15 s, and the low temperature residence time is preferably 0.13 sec. or less.

The high temperature residence time and the low temperature residence time can be adjusted by adjusting the water volume ratio in each temperature range in water cooling, and by adjusting the gas flow rate ratio in each temperature range when the inert gas is used. In both cases, the water volume or the gas flow rate in the high temperature range can be reduced than that in the low temperature range.

After cooling by the non-oxygen medium has been completed, the wire material is wound up at 750-950° C. By making the winding temperature such range, the scale thickness can be adjusted to a desired range. The winding temperature is preferably 760-940° C., more preferably 780-930° C.

Below, the chemical composition of the steel wire material of the present invention will be described.

C: 0.05-1.2%

C is an element greatly affecting the mechanical properties of steel. In order to secure the strength of the wire material, the C amount was stipulated to be 0.05% or more. The C amount is preferably 0.15% or more, more preferably 0.3% or more. On the other hand, when the C amount is excessively high, the hot workability in manufacturing the wire material deteriorates. Therefore, the C amount was stipulated to be 1.2% or less. The C amount is preferably 1.0% or less, more preferably 0.9% or less.

Si: 0.01-0.7%

Si is an element required for deoxidizing steel. When its content is too low, formation of $Fe_2SiO_4$ (fayalite) becomes insufficient, and the MD performance deteriorates. Therefore, the Si amount was stipulated to be 0.01% or more. The Si amount is preferably 0.1% or more, more preferably 0.2% or more. On the other hand, when the Si amount is excessively high, by excessive formation of $Fe_2SiO_4$ (fayalite), such problems occur that the MD performance extremely deteriorates, a surface decarburized layer is formed, and the like. Therefore, the Si amount was stipulated to be 0.7% or less. The Si amount is preferably 0.5% or less, more preferably 0.4% or less.

Mn: 0.1-1.5%

Mn is an element useful in securing the quenchability of steel and increasing the strength. In order to effectively exert such actions, the Mn amount was stipulated to be 0.1% or more. The Mn amount is preferably 0.2% or more, more preferably 0.4% or more. On the other hand, when the Mn amount is excessively high, segregation occurs in the cooling step after the hot rolling, and super-cooled structure (martensite and the like) harmful for the drawability and the like is liable to be generated. Therefore, the Mn amount was stipulated to be 1.5% or less. The Mn amount is preferably 1.4% or less, more preferably 1.2% or less.

P: 0.02% or Less (Not Including 0%)

P is an element deteriorating the toughness and ductility of steel. In order to prevent the wire breakage in the drawing step and the like, the P amount was stipulated to be 0.02% or less. The P amount is preferably 0.01% or less, more preferably 0.005% or less. Although the lower limit of the P amount is not particularly limited, it is approximately 0.001% normally.

S: 0.02% or Less (Not Including 0%)

Similarly to P, S is an element deteriorating the toughness and ductility of steel. In order to prevent the wire breakage in the drawing step and the twisting step thereafter, the S amount was stipulated to be 0.02% or less. The S amount is preferably 0.01% or less, more preferably 0.005% or less. Although the lower limit of the S amount is not particularly limited, it is approximately 0.001% normally.

N: 0.005% or Less (Not Including 0%)

N is an element deteriorating the ductility of steel when the content thereof becomes excessively high. Therefore, the N amount was stipulated to be 0.005% or less. The N amount is preferably 0.004% or less, more preferably 0.003% or less. Although the lower limit of the N amount is not particularly limited, it is approximately 0.001% normally.

The fundamental composition of the steel wire material of the present invention is as described above, and the balance is substantially iron. However, inclusion of unavoidable impurities brought in due to situations of raw materials, materials, manufacturing facilities and the like in the steel wire material is allowed as a matter of course. Further, it is also recommended to add elements described below according to the necessity within a range not impeding the actions and effects of the present invention.

Cr: 0.3% or Less (Not Including 0%) and/or Ni: 0.3% or Less (Not Including 0%)

Both of Cr and Ni are elements enhancing the quenchability of steel and contributing to increase the strength. In order to exert such actions effectively, both of the Cr amount and Ni amount are preferably 0.05% or more, more preferably 0.10% or more, and further more preferably 0.12% or more. On the other hand, when the Cr amount and Ni amount are excessively high, the martensite structure is liable to be generated, adhesiveness of the scale to the base iron increases excessively, and the peeling performance of the scale at the time of MD deteriorates. Therefore, both of the Cr amount and Ni amount are preferably 0.3% or less, more preferably 0.25% or less, and further more preferably 0.20% or less. Cr and Ni may be added respectively and independently or may be added simultaneously.

Cu: 0.3% or Less (Not Including 0%)

Cu is an element having an action of promoting peeling of the scale. In order to exert such action effectively, the Cu amount is preferably 0.01% or more, more preferably 0.05% or more, and further more preferably 0.07% or more. On the other hand, when the Cu amount is excessively high, peeling of the scale is promoted excessively, the scale peels off during rolling, other scales which are thin and highly adhesive are generated on the peeled surface, and the rust is generated when the wire material coil is stored and transported. Therefore, the Cu amount is preferably 0.3% or less, more preferably 0.25% or less, and further more preferably 0.20% or less.

at Least One Element Selected from a Group Consisting of Nb, V, Ti, Hf and Zr: 0.1% or Less (Not Including 0%) in Total All of Nb, V, Ti, Hf and Zr are elements forming fine carbonitride and contributing to increase the strength. In order to exert such actions effectively, all of the Nb amount, V amount, Ti amount, Hf amount and Zr amount are preferably 0.003% or more, more preferably 0.007% or more, and further more preferably 0.01% or more. On the other hand, when these elements are excessively high, the ductility deteriorates, and therefore the total amount thereof is preferably 0.1% or less, more preferably 0.08% or less, and further more preferably 0.06% or less. These elements may be added respectively and independently or two elements or more may be added in combination.

Al: 0.1% or Less (Not Including 0%)

Al is an element effective as a deoxidizing agent. In order to exert such action effectively, the Al amount is preferably 0.001% or more, more preferably 0.01% or more, and further more preferably 0.02% or more. On the other hand, when the Al amount is excessively high, oxide-based inclusions such as $Al_2O_3$ and the like increase, and wire breakage frequently occurs in drawing work and the like. Therefore, the Al amount is preferably 0.1% or less, more preferably 0.08% or less, and further more preferably 0.06% or less.

B: 0.005% or Less (Not Including 0%)

B is an element suppressing formation of ferrite by being present as free B (B that does not form the compound) solid-solved in steel, and is an element effective particularly in a high strength wire material which requires suppression of a longitudinal crack. In order to exert such actions effectively, the B amount is preferably 0.0001% or more, more preferably 0.0005% or more, and further more preferably 0.0009% or more. On the other hand, when the B amount is excessively high, the ductility deteriorates. Therefore, the B amount is preferably 0.005% or less, more preferably 0.0040% or less, and further more preferably 0.0035% or less.

Ca: 0.01% or Less (Not Including 0%) and/or Mg: 0.01% or Less (Not Including 0%)

Both of Ca and Mg are elements having an action of controlling the form of the inclusions and enhancing the ductility. Further, Ca also has an action of enhancing the corrosion resistance of the steel material. In order to exert such actions effectively, both of the Ca amount and the Mg amount are preferably 0.001% or more, more preferably 0.002% or more, and further more preferably 0.003% or more. On the other hand, when these elements are excessively high, the workability deteriorates. Therefore, both of the Ca amount and the Mg amount are preferably 0.01% or less, more preferably 0.008% or less, and further more preferably 0.005% or less. Ca and Mg may be added respectively and independently or may be added simultaneously.

Example

Below, the present invention will be explained more specifically referring to an example. The present invention is not limited by the example described below, and it is a matter of course that the present invention can also be implemented with modifications being added appropriately within the scope adaptable to the purposes described above and below, and any of them is to be included within the technical range of the present invention.

After steel of the chemical composition shown in Tables 1, 2 was smelted according to an ordinary smelting method, a billet of 150 mm×150 mm was manufactured and was heated inside a heating furnace. Thereafter, the primary scale formed inside the heating furnace was descaled using high-pressure water, hot rolling, cooling and winding were executed under the conditions shown in Table 3, and the steel wire material of Φ5.5 mm was obtained.

The obtained steel wire material was measured by a method described below.

(1) Measurement of Thickness of Scale

Samples with 10 mm length were taken from the front end, center part and rear end of the coil respectively, and the cross sections of the scale of optional three locations from each sample were observed using a scanning electron microscope (SEM) (observation magnification: 5,000 times). The scale thickness was measured for 10 points at every 100 μm length in the peripheral direction of the steel wire material on each measurement location, the average scale thickness thereof was obtained, and the average value of the three locations was made the scale thickness of each sample. Further, the average value of respective samples (the front end, center part and rear end of the coil) was calculated, and was made the scale thickness of each test No.

(2) Measurement of Area Ratio of Holes Inside Scale

Similarly to above (1), samples with 10 mm length were taken from the front end, center part and rear end of the coil respectively, the cross sections of the scale of optional three locations from each sample were observed using the SEM (measurement field of view: 25×20 μm, observation magnification: 5,000 times). The area ratio of the holes of the equivalent circle diameter of 1 μm or less was obtained on each measurement location, and the average value of the three locations was made the area ratio of fine (1 μm or less in terms of the equivalent circle diameter) holes of each sample. Further, the average value of respective samples (the front end, center part and rear end of the coil) was calculated, and was made the area ratio of the fine holes of each test No.

(3) Measurement of MD Performance

Samples with 250 mm length were taken from the front end, center part and rear end of the coil respectively, were applied with deformation strain of 6% by a tensile test machine, and were taken out from the chuck. Air was thereafter blown to the sample, and the scale on the surface of the steel wire material was blown out. The appearance before and after application of the strain was photographed by a digital camera, and the area ratio of the remaining scale was calculated by comparing the both by image analysis.

The results are shown in Tables 4, 5.

TABLE 1

| | Chemical composition (mass %) with the remainder being iron and unavoidable impurities | | | | | | | | | | | |
|---|---|---|---|---|---|---|---|---|---|---|---|---|
| Steel kind | C | Si | Mn | P | S | N | Cr | Ni | Cu | Al | B | Others |
| A-1 | 0.73 | 0.28 | 0.63 | 0.005 | 0.002 | 0.002 | — | — | — | — | — | — |
| A-2 | 0.73 | 0.28 | 0.63 | 0.005 | 0.002 | 0.002 | 0.25 | — | — | — | — | — |
| A-3 | 0.73 | 0.28 | 0.63 | 0.005 | 0.002 | 0.002 | — | 0.18 | — | — | — | — |
| A-4 | 0.73 | 0.28 | 0.63 | 0.005 | 0.002 | 0.002 | — | — | 0.22 | — | — | — |
| A-5 | 0.73 | 0.28 | 0.63 | 0.005 | 0.002 | 0.002 | — | — | — | 0.038 | — | — |
| A-6 | 0.73 | 0.28 | 0.63 | 0.005 | 0.002 | 0.002 | — | — | — | — | 0.0005 | — |
| A-7 | 0.73 | 0.28 | 0.63 | 0.005 | 0.002 | 0.002 | — | — | — | — | — | Hf = 0.041 |
| A-8 | 0.73 | 0.28 | 0.63 | 0.005 | 0.002 | 0.002 | — | — | — | — | — | Mg = 0.008 |
| A-9 | 0.73 | 0.28 | 0.63 | 0.005 | 0.002 | 0.002 | — | — | — | — | — | Nb = 0.056 |
| A-10 | 0.73 | 0.28 | 0.63 | 0.005 | 0.002 | 0.002 | — | — | — | — | — | V = 0.082 |
| A-11 | 0.73 | 0.28 | 0.63 | 0.005 | 0.002 | 0.002 | — | — | — | — | — | Zr = 0.05 |
| A-12 | 0.73 | 0.28 | 0.63 | 0.005 | 0.002 | 0.002 | — | — | — | — | — | Ca = 0.002 |
| A-13 | 0.73 | 0.28 | 0.63 | 0.005 | 0.002 | 0.002 | — | — | — | — | — | Ti = 0.044 |
| A-14 | 0.73 | 0.28 | 0.63 | 0.005 | 0.002 | 0.002 | 0.08 | 0.05 | — | — | — | — |
| A-15 | 0.73 | 0.28 | 0.63 | 0.005 | 0.002 | 0.002 | 0.08 | 0.19 | 0.07 | — | — | — |
| A-16 | 0.73 | 0.28 | 0.63 | 0.005 | 0.002 | 0.002 | 0.05 | 0.09 | — | 0.033 | — | — |
| A-17 | 0.73 | 0.28 | 0.63 | 0.005 | 0.002 | 0.002 | 0.18 | 0.15 | — | — | 0.0022 | — |
| A-18 | 0.73 | 0.28 | 0.63 | 0.005 | 0.002 | 0.002 | 0.12 | 0.15 | — | — | — | Ti = 0.063 |
| A-19 | 0.73 | 0.28 | 0.63 | 0.005 | 0.002 | 0.002 | 0.22 | — | 0.03 | — | — | — |
| A-20 | 0.73 | 0.28 | 0.63 | 0.005 | 0.002 | 0.002 | 0.16 | — | 0.14 | 0.026 | — | — |
| A-21 | 0.73 | 0.28 | 0.63 | 0.005 | 0.002 | 0.002 | — | 0.24 | 0.08 | — | — | — |
| A-22 | 0.73 | 0.28 | 0.63 | 0.005 | 0.002 | 0.002 | — | 0.21 | 0.09 | 0.035 | — | — |
| A-23 | 0.73 | 0.28 | 0.63 | 0.005 | 0.002 | 0.002 | — | 0.15 | 0.18 | — | 0.0009 | — |
| A-24 | 0.73 | 0.28 | 0.63 | 0.005 | 0.002 | 0.002 | — | 0.05 | 0.16 | — | — | Zr = 0.058 |

TABLE 2

| Steel kind | Chemical composition (mass %) with the remainder being iron and unavoidable impurities | | | | | | | | | | | |
|---|---|---|---|---|---|---|---|---|---|---|---|---|
| | C | Si | Mn | P | S | N | Cr | Ni | Cu | Al | B | Others |
| B | 0.05 | 0.11 | 0.28 | 0.002 | 0.003 | 0.002 | 0.29 | 0.05 | 0.05 | — | — | Ti = 0.045 |
| C | 0.19 | 0.27 | 0.42 | 0.003 | 0.001 | 0.002 | — | — | 0.08 | 0.036 | — | — |
| D | 0.52 | 0.43 | 0.86 | 0.002 | 0.003 | 0.002 | — | 0.15 | | 0.022 | — | Ca = 0.005 |
| E | 0.72 | 0.64 | 0.72 | 0.002 | 0.004 | 0.002 | — | 0.07 | 0.18 | — | 0.0005 | Ti = 0.042,V = 0.038 |
| F | 0.91 | 0.39 | 1.15 | 0.002 | 0.003 | 0.002 | 0.14 | — | 0.02 | 0.018 | — | — |
| G | 0.98 | 0.27 | 0.86 | 0.003 | 0.002 | 0.002 | 0.05 | 0.28 | 0.02 | — | — | Ca = 0.004 |
| H | 1.18 | 0.48 | 1.32 | 0.004 | 0.003 | 0.002 | 0.12 | 0.22 | 0.13 | 0.002 | 0.0021 | Ti = 0.057, Zr = 0.021 |

TABLE 3

| Manufacturing condition | Ambient atmosphere from finish rolling to start of winding | Rolling-completing temperature (° C.) | Winding temperature (° C.) | Residence time of 950° C. or above (sec) | Residence time of 950° C. or below (sec) |
|---|---|---|---|---|---|
| a | Water cooled | 1100 | 935 | 0.18 | 0.14 |
| b | Water cooled | 1080 | 870 | 0.3 | 0.14 |
| c | Atmospheric air | 1080 | 870 | 0.3 | 0.14 |
| d | Water cooled | 1020 | 815 | 3 | 0.13 |
| e | Water cooled | 1045 | 785 | 14 | 0.12 |
| f | Atmospheric air | 1045 | 785 | 14 | 0.12 |
| g | Water cooled | 1090 | 920 | 21 | 0.13 |
| h | Water cooled | 1055 | 860 | 0.5 | 0.35 |
| i | Nitrogen | 1080 | 920 | 0.6 | 0.14 |
| j | Nitrogen | 1020 | 755 | 2 | 0.1 |

TABLE 4

| No. | Steel kind | Manufacturing condition | Scale thickness (μm) | Area ratio of fine holes (%) | MD performance Remaining area ratio after applying 6% strain (%) |
|---|---|---|---|---|---|
| 1 | A-1 | b | 8.6 | 6.9 | 19 |
| 2 | A-1 | d | 7.1 | 1.2 | 11 |
| 3 | A-1 | c | 9.2 | 28 | 45 |
| 4 | A-2 | b | 9.3 | 5.6 | 19 |
| 5 | A-3 | d | 6.8 | 3.2 | 15 |
| 6 | A-4 | e | 18.5 | 0.5 | 4 |
| 7 | A-5 | i | 8.9 | 8.9 | 25 |
| 8 | A-6 | j | 14.3 | 0.2 | 5 |
| 9 | A-7 | d | 6.2 | 2.7 | 13 |
| 10 | A-8 | i | 8.5 | 9.7 | 28 |
| 11 | A-9 | b | 9.0 | 4.2 | 11 |
| 12 | A-10 | j | 15.6 | 2.1 | 9 |
| 13 | A-11 | e | 19.8 | 1.3 | 8 |
| 14 | A-12 | i | 8.7 | 6.4 | 15 |
| 15 | A-13 | d | 6.4 | 4.8 | 11 |
| 16 | A-14 | j | 14.1 | 0.1 | 4 |
| 17 | A-15 | i | 8.6 | 7.5 | 12 |
| 18 | A-16 | e | 18.9 | 4.6 | 9 |
| 19 | A-17 | d | 7.4 | 3.5 | 8 |
| 20 | A-18 | b | 8.9 | 3.1 | 10 |
| 21 | A-19 | j | 12.2 | 1.9 | 5 |
| 22 | A-20 | e | 19.2 | 2.6 | 11 |
| 23 | A-21 | i | 10.6 | 3.8 | 10 |
| 24 | A-22 | b | 9.9 | 3.4 | 11 |
| 25 | A-23 | d | 7.1 | 2.6 | 15 |
| 26 | A-24 | e | 19.0 | 1.9 | 5 |

TABLE 5

| No. | Steel kind | Manufacturing condition | Scale thickness (μm) | Area ratio of fine holes (%) | MD performance Remaining area ratio after applying 6% strain (%) |
|---|---|---|---|---|---|
| 27 | B | d | 7.8 | 2.8 | 8 |
| 28 | B | j | 16.1 | 1.4 | 6 |
| 29 | B | f | 19.5 | 15 | 35 |
| 30 | C | b | 8.1 | 5.5 | 7 |
| 31 | C | i | 9.6 | 6.8 | 8 |
| 32 | D | e | 17.9 | 3.5 | 6 |
| 33 | D | c | 9.1 | 39 | 49 |
| 34 | E | d | 7.7 | 2.8 | 5 |
| 35 | E | j | 13.6 | 2.2 | 5 |
| 36 | E | a | 5.9 | 1.1 | 37 |
| 37 | F | b | 9.0 | 6.2 | 9 |
| 38 | F | e | 18.4 | 2.4 | 4 |
| 39 | F | i | 8.6 | 8.2 | 10 |
| 40 | F | h | 4.5 | 0.7 | 42 |
| 41 | G | d | 7.2 | 1.1 | 5 |
| 42 | G | j | 12.8 | 1.8 | 4 |
| 43 | G | f | 19.5 | 12 | 31 |
| 44 | H | e | 17.2 | 2.2 | 7 |
| 45 | H | j | 14.6 | 1.9 | 7 |
| 46 | H | c | 10.1 | 41 | 52 |
| 47 | H | g | 21.8 | 48 | 63 |

Nos. 1, 2, 4-28, 30-32, 34, 35, 37-39, 41-42, 44-45 of Tables 4, 5 are examples satisfying the requirements of the present invention, the scale thickness and the area ratio of the fine holes inside the scale are appropriate, and therefore the MD property is excellent.

On the other hand, in Nos. 3, 29, 33, 36, 40, 43, 46, 47, the MD property deteriorated, because the manufacturing condition did not satisfy the requirements of the present invention.

In Nos. 3, 29, 33, 43, 46, the MD property deteriorated because the wire material was cooled in the atmospheric air after the finish rolling and the area ratio of the fine holes increased. In No. 36, the MD property deteriorated, because the high temperature residence time at 950° C. or above was short and the scale thickness became thin. In No. 40, the MD property deteriorated, because the low temperature residence time at 950° C. or below was long and the scale thickness became thin. In No. 47, the MD property deteriorated, because the high temperature residence time at 950° C. or above was too long, the scale thickness became too thick, and the scale loss increased while the area ratio of the fine holes increased.

The present invention has been described in detail and referring to a specific embodiment, however, it is clear for a person with an ordinary skill in the art that a variety of alterations and modifications can be added without departing from the spirit and scope of the present invention.

The present application is based on the Japanese Patent Application No. 2010-290884 applied on Dec. 27, 2010, and the contents thereof are hereby incorporated by reference.

INDUSTRIAL APPLICABILITY

The steel wire material of the present invention is excellent in the mechanical descaling performance after hot rolling (before drawing work), and is therefore useful as a raw material for a tire cord (steel cord, bead wire) for an automobile, hose wire, a saw wire and the like used for cutting a silicon for a semiconductor and the like.

The invention claimed is:

1. A method for manufacturing a steel wire material comprising:

hot rolling steel at 1,000-1,100° C. of rolling finish temperature, wherein the steel comprises:

C: 0.05-1.2% by mass

Si: 0.01-0.7% by mass;

Mn: 0.1-1.5% by mass;

P: 0.02 by mass % or less (not including 0%);

S: 0.02% by mass or less (not including 0%); and

N: 0.005% by mass or less (not including 0%); with the remainder being iron and unavoidable impurities, cooling the hot rolled steel by bringing a non-oxygen medium into contact with the hot rolled steel; and winding the cooled steel at 760-940° C. of winding temperature, wherein cooling is performed in the cooling step from hot rolling finish temperature to winding temperature so that the residence time of 950° C. or above becomes 0.20-20 s, the residence time of 950° C. or below becomes less than 0.15 sec as measured from 950° C. until the start of winding, wherein the steel wire has a scale with 6.0 μm or more and 20 μm or less thickness is included, and holes of an equivalent circle diameter of 1 μm or less in the scale occupy 10% or less by area.

2. The method of claim 1, wherein the non-oxygen medium is inert gas or water.

3. The method of claim 2, wherein the inert gas is nitrogen.

4. The method of claim 2, wherein holes of an equivalent circle diameter of 0.1 μm to 1 μm in the scale occupy 7% or less by area.

5. The method of claim 1, wherein holes of an equivalent circle diameter of 0.1 μm to 1 μm in the scale occupy 9% or less by area.

6. The method of claim 1, wherein holes of an equivalent circle diameter of 0.1 μm to 1 μm in the scale occupy 7% or less by area.

7. The method of claim 1, wherein holes of an equivalent circle diameter of 0.1 μm to 1 μm in the scale occupy 8% or less by area.

8. The method of claim 1, comprising hot rolling steel at 1,020-1,080° C. of rolling finish temperature.

9. The method of claim 1, comprising cooling is performed in the cooling step from hot rolling finish temperature to winding temperature so that the residence time of 950° C. or above becomes 0.3-15 s, the residence time of 950° C. or below becomes less than 0.13 sec.

10. The method of claim 1, comprising winding the cooled steel at 780-930° C. of winding temperature.

* * * * *